US010971059B2

(12) United States Patent
Guo

(10) Patent No.: US 10,971,059 B2
(45) Date of Patent: Apr. 6, 2021

(54) DISPLAY DEVICE AND CONTROL METHOD THEREOF

(71) Applicants: HEFEI BOE OPTOELECTRONICS TECHNOLOGY CO., LTD., Anhui (CN); BOE TECHNOLOGY GROUP CO., LTD., Beijing (CN)

(72) Inventor: Yuanhui Guo, Beijing (CN)

(73) Assignees: BOE TECHNOLOGY GROUP CO., LTD., Beijing (CN); HEFEI BOE OPTELECTRONICS TECHNOLOGY CO., LTD., Anhui (CN)

( * ) Notice: Subject to any disclaimer, the term of this patent is extended or adjusted under 35 U.S.C. 154(b) by 2 days.

(21) Appl. No.: 16/325,355

(22) PCT Filed: Apr. 23, 2018

(86) PCT No.: PCT/CN2018/084020
§ 371 (c)(1),
(2) Date: Feb. 13, 2019

(87) PCT Pub. No.: WO2018/214687
PCT Pub. Date: Nov. 29, 2018

(65) Prior Publication Data

US 2019/0206312 A1 Jul. 4, 2019

(30) Foreign Application Priority Data

May 26, 2017 (CN) ..... 201710385338.7

(51) Int. Cl.
*G09G 3/3208* (2016.01)
*G09G 3/36* (2006.01)

(52) U.S. Cl.
CPC ..... *G09G 3/3208* (2013.01); *G09G 3/36* (2013.01); *G09G 2320/0626* (2013.01); *G09G 2354/00* (2013.01)

(58) Field of Classification Search
CPC ..... G09G 2380/02; G09G 2320/028; G09G 2320/068; G09G 2320/0261; G06F 1/1652; H01L 2251/5338; G02F 1/1323
See application file for complete search history.

(56) References Cited

U.S. PATENT DOCUMENTS

2009/0040412 A1 2/2009 Lee
2009/0160879 A1 6/2009 Tu et al.
(Continued)

FOREIGN PATENT DOCUMENTS

CN 1404029 A 3/2003
CN 102682715 A 9/2012
(Continued)

OTHER PUBLICATIONS

PCT International Search Report, Application No. PCT/CN2018/084020, dated Jul. 27, 2018, 8 pages: with English translation.
(Continued)

*Primary Examiner* — Koosha Sharifi-Tafreshi
(74) *Attorney, Agent, or Firm* — Armstrong Teasdale LLP

(57) ABSTRACT

A display device and a control method thereof are provided. The display device includes a display panel divided into n regions along a horizontal viewing direction, wherein n is a positive integer and n≥2, a detection unit configured to detect a viewing angle corresponding to each of the n regions, the viewing angle being an angle between a sight line of a human eye and the display panel, and a control unit configured to adjust, based on the viewing angle, one or both of a grayscale voltage value of the region of the display panel corresponding to the viewing angle, and brightness of
(Continued)

a part of a backlight of the display panel corresponding to the region corresponding to the viewing angle.

11 Claims, 7 Drawing Sheets

(56) References Cited

U.S. PATENT DOCUMENTS

2013/0181894 A1* 7/2013 Xu ..... G09G 3/20 345/156
2014/0146069 A1* 5/2014 Tan ..... G09G 3/20 345/589
2015/0301672 A1* 10/2015 Kim ..... G09G 3/20 345/156
2016/0148554 A1* 5/2016 Lim ..... G09G 3/342 345/694
2016/0205391 A1* 7/2016 Kim ..... H04N 13/332 348/51
2017/0039956 A1* 2/2017 Feng ..... G06K 9/2027
2017/0322449 A1* 11/2017 Irie ..... G02F 1/133528
2018/0188577 A1* 7/2018 Chen ..... G02F 1/13306

FOREIGN PATENT DOCUMENTS

CN 103578430 A 2/2014
CN 104297960 A 1/2015
CN 104392706 A 3/2015
CN 104698647 A 6/2015
CN 106601200 A 4/2017
CN 107123402 A 9/2017

OTHER PUBLICATIONS

PCT Written Opinion, Application No. PCT/CN2018/084020, dated Jul. 27, 2018, 6 pages.: with English translation of relevant part.
China First Office Action, Application No. 201710385338.7, dated Dec. 19, 2018, 16 pps.: with English translation.
China Second Office Action, Application No. 201710385338.7, dated May 20, 2019, 12 pps.: with English translation.

* cited by examiner

DISPLAY DEVICE AND CONTROL METHOD THEREOF

CROSS REFERENCE TO RELATED APPLICATIONS

This patent application is a National Stage Entry of PCT/CN2018/084020 filed on Apr. 23, 2018, which claims the benefit and priority of Chinese Patent Application No. 201710385338.7 filed on May 26, 2017, the disclosures of which are incorporated by reference herein as part of the present application.

BACKGROUND

The present disclosure generally relates to the field of display technologies, and more particularly, to a display device and a control method thereof.

With the rapid development of display technologies, various types of display devices have emerged, among which liquid crystal display (LCD) devices and organic light emitting diode (OLED) display devices are most widely used.

However, whether it is a liquid crystal display device or an OLED display device, there are problems of uneven image display quality when they are viewed from the side (especially for large-sized flat display devices) or when they are bent (especially for small-sized curved display devices, for example, wearable display devices).

BRIEF DESCRIPTION

An aspect of the present disclosure provides a display device, which includes a display panel, a detection unit, and a control unit. The display panel is divided into n regions along a horizontal viewing direction, wherein n is a positive integer and n≥2. The detection unit is configured to detect a viewing angle corresponding to each of the n regions, the viewing angle being an angle between a sight line of a human eye and the display panel. The control unit is configured to adjust, based on the viewing angle, one or both of a grayscale voltage value of the region of the display panel corresponding to the viewing angle, and brightness of a part of a backlight of the display panel corresponding to the region corresponding to the viewing angle.

In an exemplary embodiment, the viewing angle is represented by one or both of the following parameters: a distance from a viewing position to each of the n regions of the display panel, and a bending degree of the display panel in each of the n regions.

In an exemplary embodiment, the control unit is configured to perform the adjustment by one or both of the following operations: reducing the grayscale voltage value of the region corresponding to the viewing angle as the viewing angle is decreased, and increasing the brightness of the part of the backlight of the display panel corresponding to the region corresponding to the viewing angle as the viewing angle is decreased.

In an exemplary embodiment, the detection unit includes at least one of a position detection subunit and a bending degree detection subunit. The position detection subunit is configured to detect the distance from the viewing position to the region. The bending degree detection subunit is configured to detect the bending degree of the display panel in the region.

In an exemplary embodiment, the detection unit includes m bending degree detection subunits, wherein m is a positive integer and m≥n. In the case where m is greater than n, a region having a larger bending degree among the n regions is provided with at least two said bending degree detection subunits.

In an exemplary embodiment, the bending degree detection subunit is arranged on the display panel.

In an exemplary embodiment, the display device further includes a flexible substrate arranged on a side away from a light exit side of the display panel, wherein the bending degree detection subunit is arranged on the flexible substrate.

In an exemplary embodiment, the detection unit includes n position detection subunits corresponding to the n regions, and each of the position detection subunits is configured to detect the distance from the viewing position to the corresponding region of the display panel.

In an exemplary embodiment, the detection unit includes one position detection subunit positioned in one of the n regions, and the one position detection subunit is configured to detect the distance from the viewing position to the region where the one position detection subunit is located, and calculate distances from the viewing position to other regions of the n regions based on an angle between the display panel and a connecting line of the viewing position and the one position detection subunit, and distances from the other regions to the region where the one position detection subunit is located.

In an exemplary embodiment, the display device is a liquid crystal display device or an organic light emitting diode (OLED) display device.

Another aspect of the present disclosure provides a method for controlling a display device. The display device includes a display panel divided into n regions along a horizontal viewing direction, wherein n is a positive integer and n≥2. The method includes detecting a viewing angle corresponding to each of the n regions, the viewing angle being an angle between a sight line of a human eye and the display panel, and adjusting, based on the viewing angle, one or both of: a grayscale voltage value of a region of the display panel corresponding to the viewing angle, and brightness of a part of a backlight of the display panel corresponding to the region corresponding to the viewing angle.

In an exemplary embodiment, the viewing angle is represented by one or both of the following parameters: a distance from a viewing position to each of the n regions of the display panel, and a bending degree of the display panel in each of the n regions.

In an exemplary embodiment, the adjusting includes one or both of reducing the grayscale voltage value of the region corresponding to the viewing angle as the viewing angle is decreased, and increasing the brightness of the part of the backlight of the display panel corresponding to the region corresponding to the viewing angle as the viewing angle is decreased.

BRIEF DESCRIPTION OF THE DRAWINGS

To describe the technical solutions of the embodiments of the present disclosure more clearly, the accompanying drawings required to be used in the description of the embodiments of the present disclosure will be briefly introduced below. Apparently, the accompanying drawings in the following description show merely some embodiments of the present disclosure, and persons of ordinary skill in the art may still derive other drawings from these accompanying drawings without creative efforts. In the drawings.

Corresponding reference numerals indicate corresponding parts or features throughout the several views of the drawings.

DETAILED DESCRIPTION

Technical solutions in embodiments of the present disclosure will be described clearly and completely below with reference to the accompanying drawings in embodiments of the present disclosure. Apparently, the described embodiments are some but not all of the embodiments of the present disclosure. All other embodiments obtained by persons of ordinary skill in the art based on the embodiments of the present disclosure without creative efforts shall fall within the protection scope of the present disclosure.

As used herein and in the appended claims, the singular form of a word includes the plural, and vice versa, unless the context clearly dictates otherwise. Thus, singular words are generally inclusive of the plurals of the respective terms. The words "comprise", "include" and grammatical variations thereof are to be interpreted inclusively rather than exclusively, unless such a construction is clearly prohibited from the context. Where used herein the term "examples" particularly when followed by a listing of terms is merely exemplary and illustrative, and should not be deemed to be exclusive or comprehensive.

The units or modules described herein may be implemented as a combination of a processor and a memory, wherein the processor executes a program stored in the memory to implement the functionality of the corresponding units or modules. The units or modules described herein may also be completely implemented by hardware, including but not limited to Application Specific Integrated Circuits (ASICs) and Field Programmable Gate Arrays (FPGAs). Alternatively, the units or modules described herein also may be implemented upon combination of hardware and software (and/or firmware).

Figure 1A:
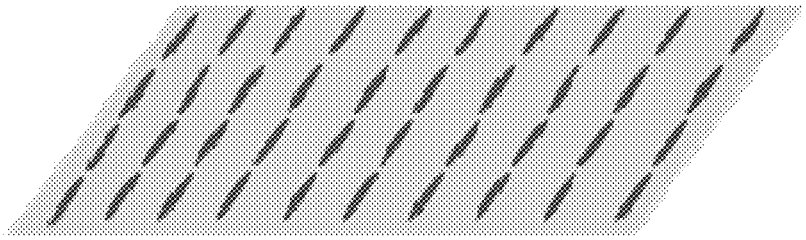
FIG. 1A illustrates an exemplary twisted state of liquid crystal in the case where a liquid crystal display device is in a L0 state.
Figure 1B:
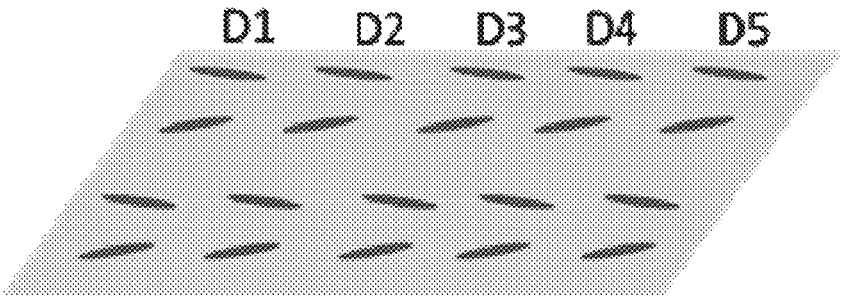
FIG. 1B illustrates an exemplary twisted state of liquid crystal in the case where a liquid crystal display device is in a L255 state.
Figure 2:
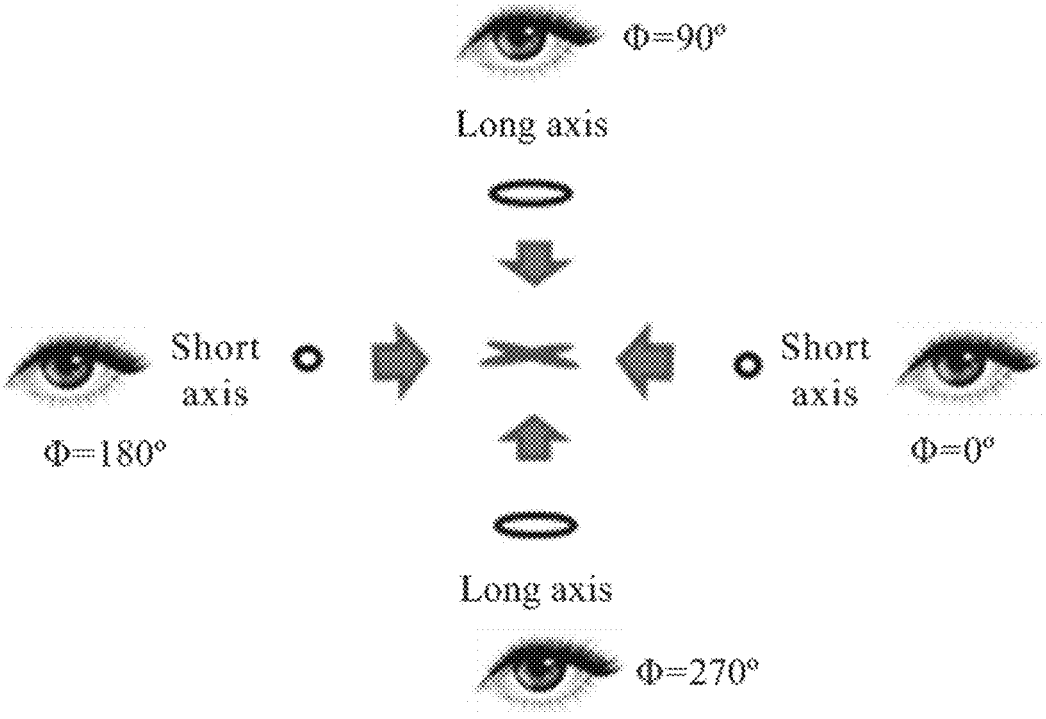
FIG. 2 illustrates exemplary states of long and short axes of liquid crystal for different viewing angles in the L255 state.

FIG. 1A and FIG. 1B respectively illustrate an exemplary twisted state of liquid crystal in the case where a liquid crystal display device is in a L0 state and a L255 state. As shown in FIG. 1A and FIG. 1B, in the L0 state, liquid crystal molecules are neatly aligned, whereas in the L255 state, the liquid crystal is twisted. Long and short axes of the liquid crystal are in different states for different viewing angles in the L255 state. FIG. 2 illustrates an exemplary state of long and short axes of the liquid crystal for different viewing angles in the L255 state. As shown in FIG. 2, in the case where the viewing angle $\Phi=90°$ or $\Phi=270°$, the state of long axis of the liquid crystal is observed by an observer as at a front viewing angle. In the case where the viewing angle $\Phi=0°$ or $\Phi=180°$, only the short axis of the liquid crystal may be observed. A refractive index ($\Delta n$) of the liquid crystal is smaller when observed from the side, and thus the image observed from the side view is bluish.

Figure 3A:
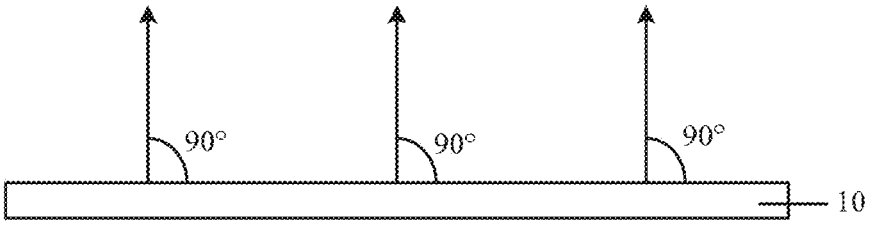
FIG. 3A illustrates an angle between a sight line of a human eye and a display device in the case where the display device is in an unbent state.
Figure 3B:
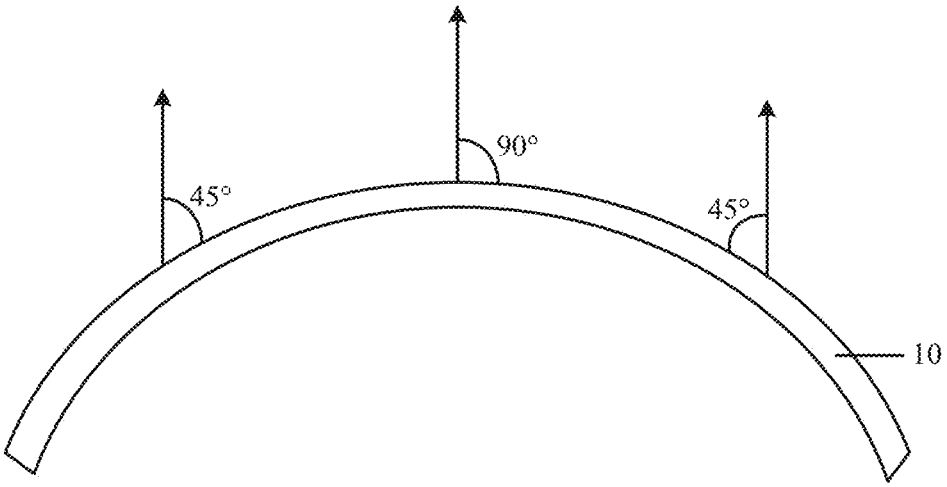
FIG. 3B illustrates angles between the sight line of the human eye and the display device in the case where the display device is in a bent state.

FIG. 3A and FIG. 3B respectively illustrate an angle between a sight line of a human eye and a display device in the case where the display device is in an unbent state and angles between the sight line of the human eye and the display device in the case where the display device is in a bent state. As shown in FIG. 3A, in the case where the display device has a small size and the display device is not bent, the angle between the sight line of the human eye and the display device may be approximately regarded as 90°. However, as shown in FIG. 3B, the angle between the sight line of the human eye and a center position of the display device is 90° and the angle between the sight line of the human eye and an edge position of the display device is smaller than 90° in the case where the display device is in the bent state (in the figure, an example is taken where the display device is bulged toward an observation side, of course the display device is also likely bulged toward a direction away from the observation side). The farther away from the center position, the smaller the angle between the sight line of the human eye and the display device is. In the case where the display device is in the bent state, the liquid crystal has a smaller refractive index for the angle of the sight line of the human eye with respect to an edge position. Therefore, the displayed image becomes bluish at the edge position. Generally, the smaller the radius of curvature of a display panel 10 is, the more bluish it is.

Figure 4:
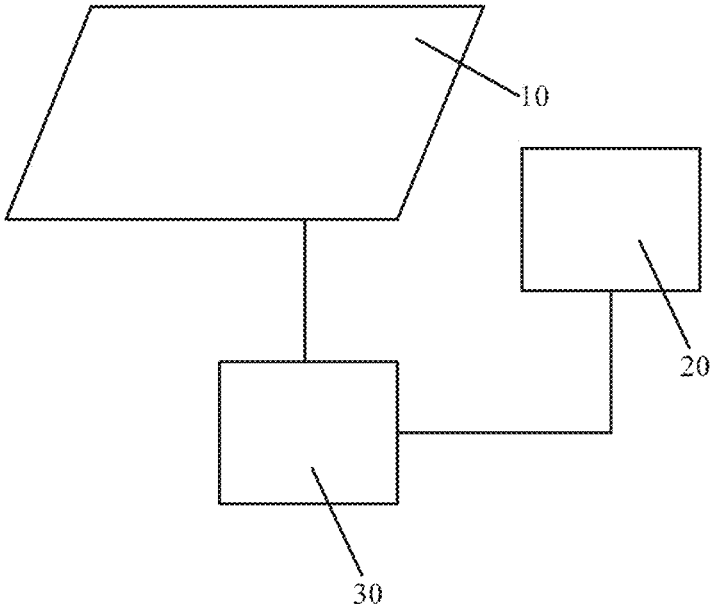
FIG. 4 is a schematic structural diagram of a display device according to an embodiment of the present disclosure.

An embodiment of the present disclosure provides a display device. FIG. 4 is a schematic structural diagram of a display device according to an embodiment of the present disclosure. As shown in FIG. 4, the display device includes a display panel 10, a detection unit 20, and a control unit 30. The display panel 10 is divided into n regions along a horizontal viewing direction, wherein n is a positive integer and n≥2. The detection unit 20 is configured to detect a viewing angle corresponding to each of the n regions. In an exemplary embodiment, the viewing angle is an angle between a sight line of a human eye and the display panel 10. The control unit 30 is configured to adjust, based on the viewing angle, one or both of i) a grayscale voltage value of a region of the display panel 10 corresponding to the viewing angle, and ii) brightness of a part of a backlight of the display panel 10 corresponding to the region corresponding to the viewing angle.

Figure 5A:
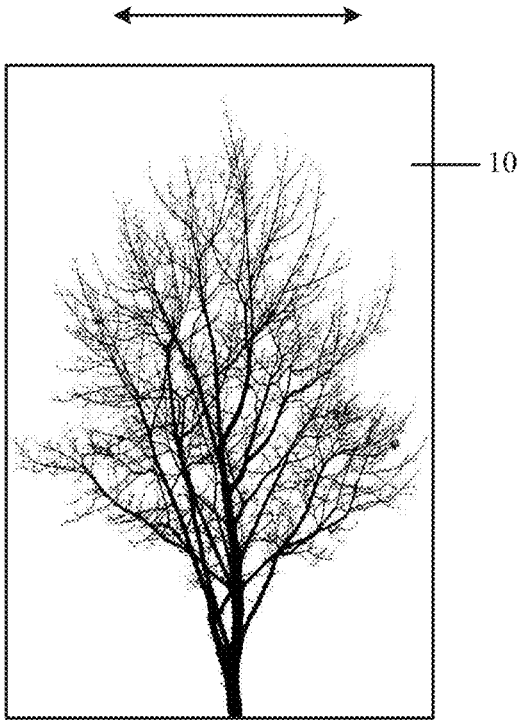
FIG. 5A is an example of a horizontal viewing direction according to an embodiment of the present disclosure.
Figure 5B:
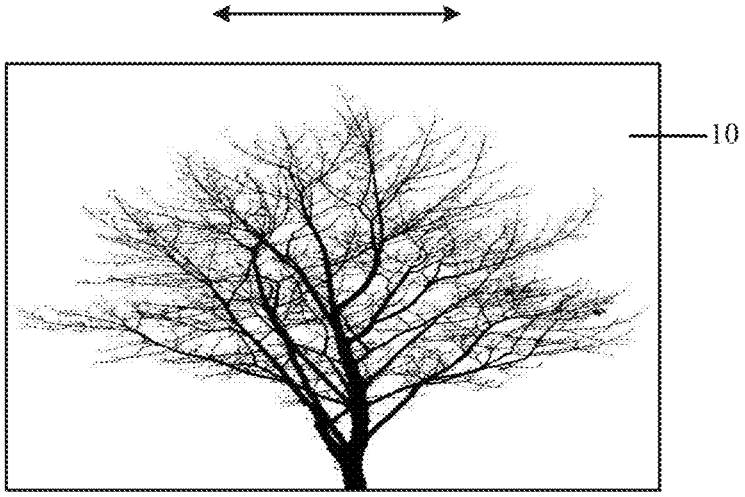
FIG. 5B is another example of a horizontal viewing direction according to an embodiment of the present disclosure.

As used herein, the term "horizontal viewing direction" refers to a direction in parallel to a connecting line between two eyes of a human in the case where the human views the display screen from front. As an example, no matter the display panel 10 is in a horizontal display or a vertical display, the horizontal viewing direction is a direction in parallel to the connecting line between two eyes in the case where the human views the display screen from the front, as indicated by arrows in FIG. 5A and FIG. 5B.

In some embodiments of the present disclosure, the display panel 10 may be divided into two regions, or three or even more regions along the horizontal viewing direction. The more regions the display panel 10 is divided along the horizontal direction, the more accurately an image displayed by the display panel 10 may be adjusted, such that the image to be displayed is more uniform.

Figure 6A:
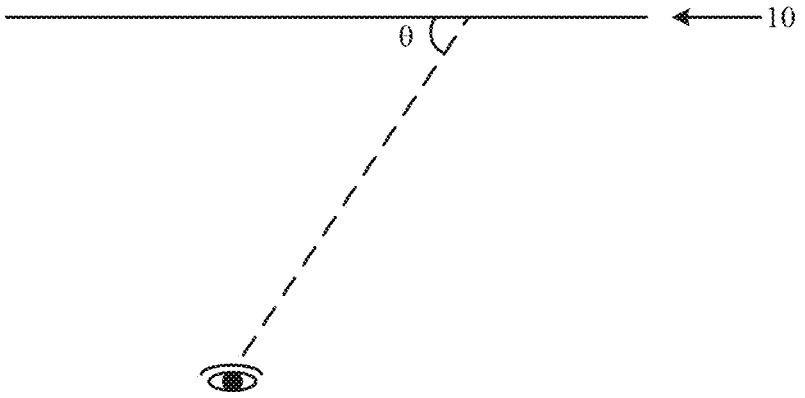
FIG. 6A is a schematic diagram of a viewing angle for a flat display panel according to an embodiment of the present disclosure.
Figure 6B:
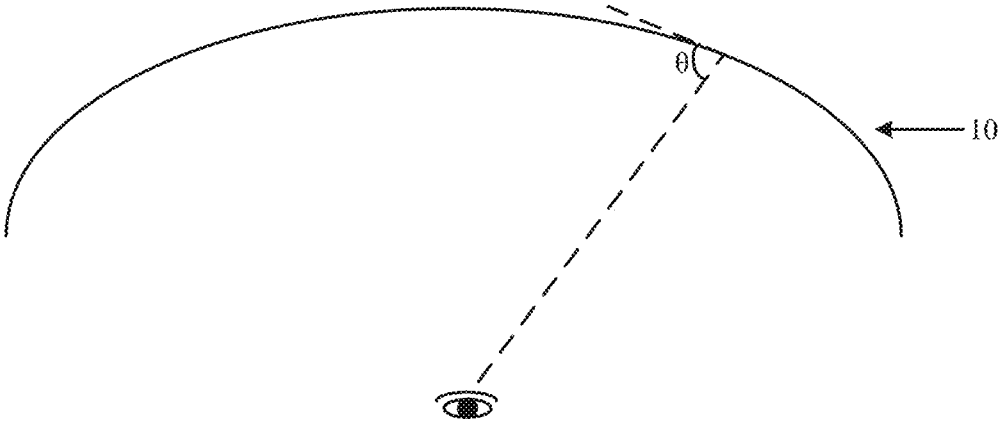
FIG. 6B is a schematic diagram of viewing angles for a curved display panel according to an embodiment of the present disclosure.

In the case where the display panel 10 is a flat display panel, "an angle between a sight line of a human eye and the display panel 10" may refer to an angle between the display panel 10 and a connecting line of the human eye and a fixation point of the human eye on the display panel 10 (i.e., a sight line of a human eye), as shown in FIG. 6A. In the case where the display panel 10 is a curved display panel, "an angle between a sight line of a human eye and the display panel 10" may refer to an angle between a tangent line of a fixation point of the human eye on the display panel 10 and a connecting line of the human eye and the fixation point of the human eye on the display panel 10 (i.e., a sight line of a human eye), as shown in FIG. 6B.

In some embodiments of the present disclosure, types of the display device are not limited, which either may be a liquid crystal display (LCD) device, or may be an organic light-emitting diode (OLED) display device. Furthermore, the display device in some embodiments of the present disclosure may be a flexible display device that is bendable.

In the case where the display device is a liquid crystal display device, the liquid crystal display device may include for example a liquid crystal display panel and a backlight which is used for providing a light source to the liquid crystal display panel. In the case where the viewer views from the side or the liquid crystal display panel is bent, the states of the long and short axes of the liquid crystal are different for different viewing angles, which results in different refractive indices of the liquid crystal in different directions, so the viewer may observe uneven display (for example, color shift). In an exemplary embodiment of the present disclosure, the control unit 30 may adjust, based on the viewing angle obtained by the detection unit 20, the grayscale voltage value of a region of the display panel 10 corresponding to the viewing angle. In an alternative embodiment, the control unit 30 may adjust, based on the viewing angle obtained by the detection unit 20, the brightness of a part of a backlight of the display panel 10 corresponding to the region corresponding to the viewing angle. In another alternative embodiment, the control unit 30 may adjust, based on the viewing angle obtained by the detection unit 20, the grayscale voltage value of the region of the display panel 10 corresponding to the viewing angle and the brightness of the part of the backlight of the display panel 10 corresponding to the region corresponding to the viewing angle.

In the case where the display device is an organic light-emitting diode display device, the organic light-emitting diode display device may include an anode, a cathode, and an organic layer arranged between the anode and the cathode, wherein the organic layer is used for emitting light. The emission spectrum of the organic light-emitting diode display device is greatly affected by a microcavity effect. In the case that the viewer views from the side or the display panel is bent, the emission spectra for the side viewing angle and the front viewing angle are different, and the emission spectra of the bent portion and the non-bent portion are different, so the viewer may see uneven image (for example, color shift) on the display screen. In this case, the control unit 30 may adjust, based on the viewing angle obtained by the detection unit 20, the grayscale voltage value of the region of the display panel 10 corresponding to the viewing angle.

By way of example, the grayscale voltage value of the corresponding region may be implemented by adjusting the magnitude of the voltage applied to a data line. The brightness of the part of the backlight corresponding to the corresponding region may be implemented by adjusting the magnitude of current.

In the case where the display device is the liquid crystal display device, the backlight may be a side-light type backlight or a direct-light-type backlight. In the case where the backlight is the side-light type backlight, a plurality of light emitting diodes (LEDs) may be sequentially arranged along the horizontal viewing direction.

In an exemplary embodiment of the present disclosure, the control unit 30 may adjust, based on the viewing angle, the grayscale voltage value of the display panel 10 the region corresponding to the viewing angle and/or the brightness of the part of the backlight of the display panel 10 corresponding to the region corresponding to the viewing angle as described above, and thus image displayed on the display panel 10 may be adjusted. As an example, as the viewing angle decreases, the control unit 30 may perform one or both of the following operations: i) reducing the grayscale voltage value of the region of the display panel 10 corresponding to the viewing angle, and ii) increasing the brightness of the part of the backlight of the display panel 10 corresponding to the region corresponding to the viewing angle. By adjusting one or both of the grayscale voltage value applied to the display panel 10 and the brightness of the backlight, it may be avoided a phenomenon that the viewer may see uneven images (for example, color shift) on the display screen when the viewer views from the side or the display panel 10 is bent, such that the quality of the displayed image is improved.

In an exemplary embodiment, the viewing angle may be represented by one or both of the following parameters: i) a distance from a viewing position to each of the n regions of the display panel 10, and ii) a bending degree of the display panel 10 in each of then regions.

In the exemplary embodiment, both the distance from a viewing position to each of the n regions of the display panel 10 and the bending degree of the display panel 10 in each of the n regions may represent the viewing angle. As an example, the larger the distance from a viewing position to a separate region of the display panel 10 is, the smaller the viewing angle is, and the larger the bending degree of the display panel 10 is, the smaller the viewing angle is.

In the case where the display panel 10 is a flat display panel, the curvature of the flat display panel is zero, and the viewing angle is only related to the distance from the viewing position to each region of the display panel 10. Therefore, in this case, the viewing angle may be represented only by the distance from the viewing position to each region of the display panel 10. In the case where the display panel 10 is a small-sized curved display panel, such as a pair of wearable glasses or a wearable helmet, all light rays from the respective regions of the display panel to the viewing position may be considered as to be approximately parallel, that is, the distance from the viewing position to each region of the display panel 10 substantially has no effect on the viewing angle. In this case, the viewing angle is only related to the bending degree of the display panel 10 in each region. Therefore, the viewing angle may be represented only by the bending degree of the display panel 10 in each region. In the case where the display panel 10 is a large-sized curved display panel, the viewing angle is related to both the distance from the viewing position to each region of the display panel 10 and the bending degree of the display panel 10 in each region. Therefore, in this case, the viewing angle may be represented by the distance from the viewing position to each region of the display panel 10 and the bending degree of the display panel 10 in each region.

Here, the bending degree may be represented, for example, by curvature or radius of curvature. However, this is not intended to limit the scope of the present disclosure to a particular representation of the bending degree, and those skilled in the art may readily appreciate how to adapt relevant conditions and settings when other representations are employed. Furthermore, the present disclosure does not limit how to detect the bending degree of the display panel 10 in each region. As an example, the bending degree of the display panel 10 in each region may be detected by a curvature sensor.

Similarly, the present disclosure does not limit how to detect the distance from the viewing position to each region of the display panel 10. As an example, the distance may be detected by an infrared probe.

In an exemplary embodiment, the control unit 30 may be configured to perform the adjustment by one or two of the following operations: i) reducing the grayscale voltage value of the region of the display panel 10 corresponding to the viewing angle as the viewing angle is decreased, and ii) increasing the brightness of the part of the backlight of the display panel 10 corresponding to the region corresponding to the viewing angle as the viewing angle is decreased.

In the case where the display panel 10 is a liquid crystal display panel, as an example, the control unit 30 may control the grayscale voltage value of the region of the display panel 10 corresponding to the viewing angle to decrease as the viewing angle is decreased. As another example, the control unit 30 may control the brightness of the part of the backlight of the display panel 10 corresponding to the region corresponding to the viewing angle to increase as the viewing angle decreases. As still another example, the control unit 30 may control the grayscale voltage value of the region of the display panel 10 corresponding to the viewing angle to decrease, and the control unit 30 may control the brightness of the part of the backlight of the display panel 10 corresponding to the region corresponding to the viewing angle to increase as the viewing angle decreases. In the case where the display panel 10 is an organic light-emitting diode display panel, the control unit 30 may control the grayscale voltage value of the region of the display panel 10 corresponding to the viewing angle to decrease as the viewing angle decreases.

Here, the decrease magnitude of the grayscale voltage value for the corresponding region and the increase amplitude of the brightness of the backlight may be determined based on the viewing angle, such that an image to be displayed by the display panel 10 has no or smaller color shift after being adjusted by the control unit 30. In an exemplary embodiment of the present disclosure, the grayscale voltage value is decreased on the basis of a predetermined grayscale voltage value of an image to be displayed. By way of example, the smaller the viewing angle is, the more the grayscale voltage value decreases, and the more the brightness of the backlight increases.

The display device provided by some embodiments of the present disclosure is described below with reference to specific examples.

Figure 7:
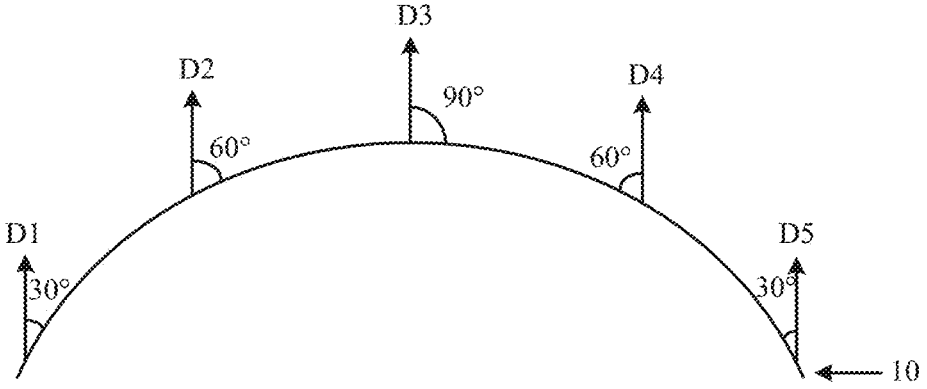
FIG. 7 is a schematic diagram of a display panel divided into five regions according to an embodiment of the present disclosure.

Taking a small-sized liquid crystal display panel as an example, the display panel may have the following parameters or settings: the size of the display panel is 8×20 $cm^2$, the backlight of the display panel is a long side-light type backlight, and the number of LEDs serving as the light source is 10; as shown in FIG. 7, the display panel is divided into five regions (D1-D5) along the horizontal viewing direction, and for a flat (i.e., non-curved) liquid crystal display panel, in the L255 state, chromaticity coordinates of the display panel in the regions D1-D5 are the same, for example, (0.30, 0.32), wherein the chromaticity coordinates in some embodiments of the present disclosure are in the CIE 1931 coordinate system.

As a comparative example, for a curved (i.e., bent) liquid crystal display panel having a radius of curvature of, for example, 15 cm, it is assumed that the grayscale voltage values applied to the regions D1-D5 are the same and the brightness of the backlights corresponding to the respective regions is the same. For example, the grayscale voltage values applied to the regions D1-D5 are 4V, and the current of LED lamps is 20 mA. It is detected that the chromaticity coordinate of the region D3 of the display panel is (0.30, 0.32), the chromaticity coordinates of the region D1 and the region D5 are (0.29, 0.30), and the chromaticity coordinates of the region D2 and the region D4 are (0.295, 0.31).

Figure 8:
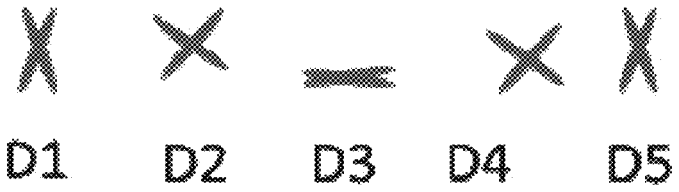
FIG. 8 illustrates an exemplary state of long and short axes of liquid crystal for different viewing angles in regions D1-D5 in a comparative example.

As can be seen from the detection results of the chromaticity coordinates, in the case where the grayscale voltage values applied to the respective regions are the same and the brightness of the backlight corresponding to each region is the same, the chromaticity coordinates of the region D1 and the region D5 are lower, and the region D1 and the region D5 are seriously bluish. This is because the liquid crystal display panel has different viewing angles for the regions D1-D5 in the L255 state. As shown in FIG. 8, the states of the long and short axes of the liquid crystal are different, such that Δn of the center region D3 is larger, and Δn of the region D1 and Δn of the region D5 are smaller, and thus the regions D1 and D5 appear bluish.

As an example of the present disclosure, for a curved (i.e., bent) liquid crystal display panel having a radius of curvature of, for example, 15 cm, the grayscale voltage values for different regions and the current of the LED lamps (brightness of the backlight) are adjusted. As an example, the grayscale voltage value for the region D3 is 4V, the current of the LED lamp corresponding to the region D3 is 20 mA, the grayscale voltage values for the region D2 and the region D4 are 3.5V, current of the LED lamp corresponding to the region D2 and the region D4 is 25 mA, the grayscale voltage values for the region D1 and the region D5 are 3V, and the current of the LED lamp corresponding to the region D1 and the region D5 is 30 mA. Next, the chromaticity coordinates of the regions D1-D5 of the display panel are detected. In this way, it may be obtained that the chromaticity coordinate of the region D3 is still (0.30, 0.32), the chromaticity coordinates of the region D2 and the region D4 are (0.30, 0.317), and the chromaticity coordinates of the region D1 and the region D5 are (0.295, 0.315).

Figure 9A:
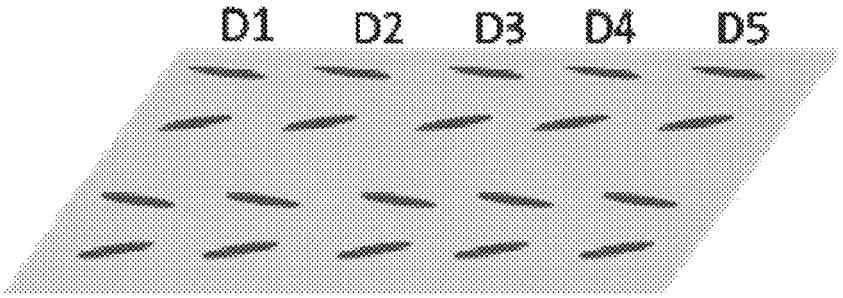
FIG. 9A illustrates an exemplary twisted state of liquid crystal in the case where a liquid crystal display device is in a L255 state according to an embodiment of the present disclosure.
Figure 9B:
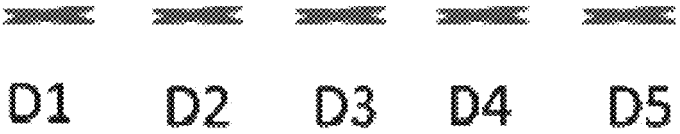
FIG. 9B illustrates an exemplary state of long and short axes of liquid crystal for different viewing angles in regions D1-D5 according to an embodiment of the present disclosure.

As can be seen, after the grayscale voltage values of different regions are adjusted, the twisted states of the liquid crystal molecules are changed (as shown in FIG. 9A) in the case where the liquid crystal display panel is in the L255 state. In this case, as shown in FIG. 9B, for the different viewing angles in the regions D1-D5, the states of the long and short axis (the twisted state) of the liquid crystal molecules are substantially the same, so the color shift of the image to be displayed may be avoided. Furthermore, by adjusting the brightness of the part of the backlight corresponding to the regions D1-D5 of the display panel 10, it may be ensured that the regions D1-D5 of the display panel 10 have uniform brightness.

Figure 10:
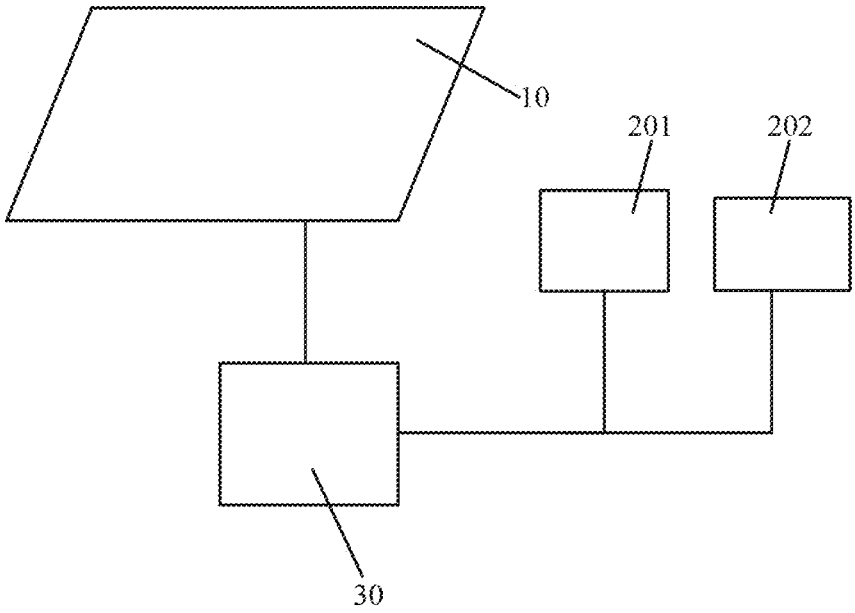
FIG. 10 is a schematic structural diagram of another display device according to an embodiment of the present disclosure.

In an exemplary embodiment, as shown in FIG. 10, the detection unit 20 may include a position detection subunit 202 and a bending degree detection subunit 201. The position detection subunit 202 may be configured to detect the distance from the viewing position to each region. The bending degree detection subunit 201 may be configured to detect the bending degree of the display panel 10 in each region.

In the case where the display panel is a small-sized curved display panel, the detection unit 20 may only include the bending degree detection subunit 201. In the case where the display panel is a flat display panel, the detection unit 20 may only include the position detection subunit 202. In the case where the display panel is a large-sized curved display panel, the detection unit 20 may include both the bending degree detection subunit 201 and the position detection subunit 202.

The present disclosure does not limit the number of the position detection subunits 202 and the bending degree detection subunits 201, which may be, for example, one or two or even more, and may be appropriately selected by those skilled in the art according to actual needs. As an example, in the case where the surface of the curved display panel is a circular arc surface, the curvatures of the individual regions of the circular arc surface are equal, so only one bending degree detection subunit 201 may be provided, by which the curvature of any region on the circular arc surface may be detected. Based on the detected curvature, the viewing angle of this region may be calculated out. Further, based on the distances from other regions of the n regions to this region, the viewing angles of the other regions may be calculated out. As still another example, in the case where the surface of the curved display panel is a non-circular arc surface, the curvatures of the n regions of the curved display panel may be not identical, and thus it is required to separately arrange the bending degree detection subunit 201 in each of the n regions of the display panel 10. The bending degrees of the n regions may be detected by the n bending degree detection subunits 201. The viewing angles of the n regions may be calculated out based on the detected bending degrees of the n regions.

Here, the present disclosure does not limit positions where the position detection subunits 202 and the bending degree detection subunits 201 are arranged, which may be arranged, for example, on the display panel 10 or on other substrates. In the case where the position detection subunits 202 and the bending degree detection subunits 201 are arranged on other substrates, the other substrates may have n regions that correspond, one to one, to the n regions on the display panel 10.

Moreover, the present disclosure does not limit the types of the position detection subunits 202. As an example, the position detection subunit 202 may be an infrared sensor. The present disclosure does not limit the types of the bending degree detection subunits 201. As an example, the bending degree detection subunit 201 may be a curvature sensor such as an optical fiber curvature sensor.

In some embodiments of the present disclosure, the detection unit 20 includes two individual subunits, i.e., the position detection subunit 202 and the bending degree detection subunit 201. Therefore, in the case where the display panel 10 is a flat display panel, it is unnecessary to provide the bending degree detection subunit 201 for the detection unit 20. In the case where the display panel 10 is a small-sized curved display panel, it is unnecessary to provide the position detection subunit 202 for the detection unit 20. Therefore, production costs of the display device may be reduced.

In an exemplary embodiment, the detection unit may include m bending degree detection subunit 201, wherein m is a positive integer and $m \geq n$.

By way of example, when m is equal to n, one bending degree detection subunit 201 may be arranged in each region of the display panel 10, such that the n bending degree detection subunits 201 may respectively detect the bending degrees of the n regions of the display panel 20. In the case where m is greater than n, at least two bending degree detection subunits 201 may be arranged in a region of the display panel having a larger bending degree. Generally, the regions on both sides of the display panel 10 have larger bending degrees. In order to accurately detect the bending degrees of the regions on both sides of the display panel 10, two or even more bending degree detection subunits 201 may be arranged in the regions on both sides of the display panel 10 having larger bending degrees, whereas one bending degree detection subunit 201 is arranged in each of the other regions having smaller bending degrees.

In this example, the m bending degree detection subunits 201 may respectively detect the bending degrees of the n regions of the display panel 10, so the bending degree of each region may be accurately detected, such that the grayscale voltage value of each region of the display panel 10 and/or the brightness of the part of the backlight of the display panel 10 corresponding to each region may be adjusted based on the bending degree of each region.

Figure 11:
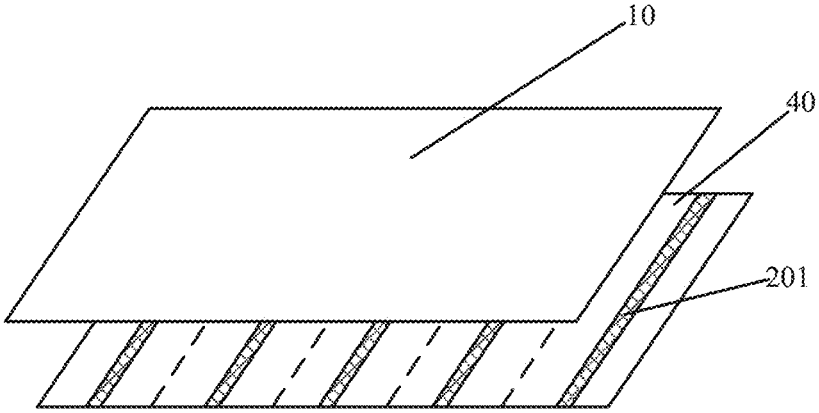
FIG. 11 is a schematic structural diagram of a bending degree detection subunit arranged on a flexible substrate according to an embodiment of the present disclosure.

As a further example, the bending degree detection subunit 201 may be arranged on the display panel 10. Alternatively, the display device may further include a flexible substrate arranged on a side away from a light exit side of the display panel 10, and the bending degree detection subunit 201 may be arranged on the flexible substrate 40 (as shown in FIG. 11).

In the embodiment in which the bending degree detection subunit 201 is arranged on the flexible substrate 40, the display panel 10 may be bent in synchronization with the flexible substrate 40. That is, the bending degree of each region of the display panel 10 is the same as that of the corresponding region of the flexible substrate 40. Therefore, detecting the bending degree of the flexible substrate 40 by the bending degree detection subunit 201 is equivalent to detecting the bending degree of the display panel 10.

Figure 12A:
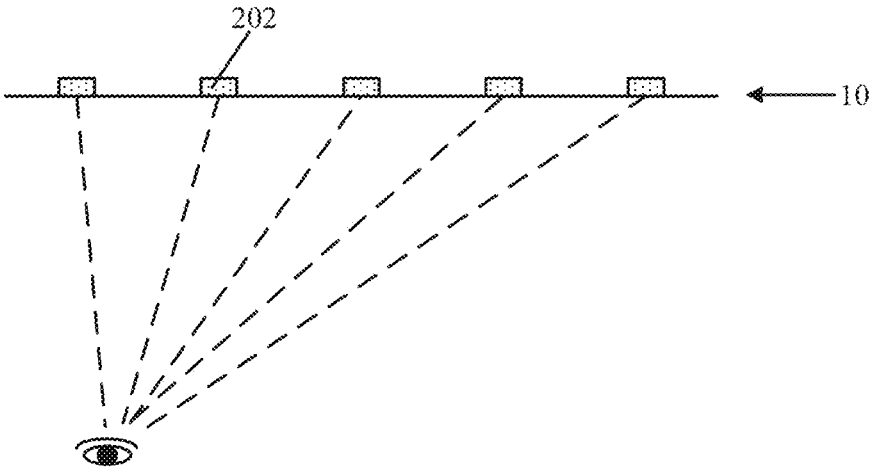
FIG. 12A is a schematic structural diagram of a display device including n position detection subunits according to an embodiment of the present disclosure.

In an exemplary embodiment, as shown in FIG. 12A, the detection unit may include n position detection subunits 202 (for example, n is equal to 5 in FIG. 12A), which may respectively detect the distances from the viewing position to the n regions of the display panel 10.

Figure 12B:
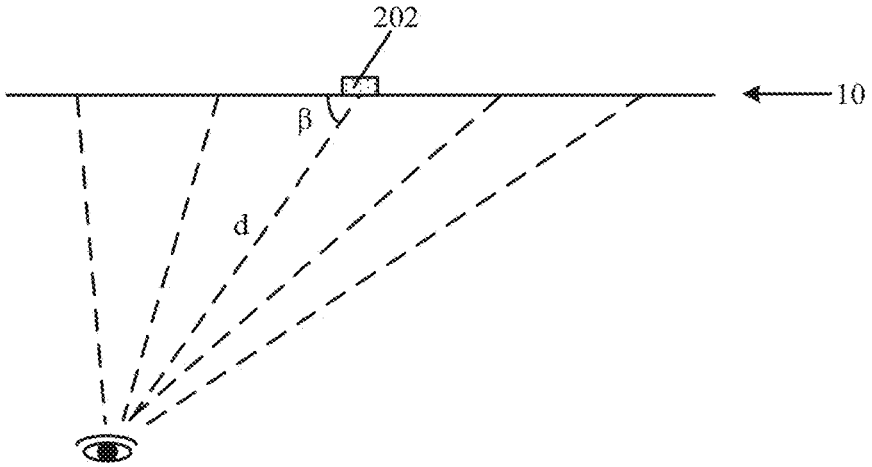
FIG. 12B is a schematic structural diagram of a display device including one position detection subunit according to an embodiment of the present disclosure.

Alternatively, as shown in FIG. 12B, the detection unit may include one position detection subunit 202, which is configured to detect the distance d from the viewing position to the region where this position detection subunit 202 is located, and calculate distances from the viewing position to other regions of the n regions based on an angle β between the display panel 10 and a connecting line of the viewing position and the position detection subunit 202, and on distances from the other regions to the region where this position detection subunit 202 is.

In some embodiments of the present disclosure, by arranging the position detection subunit 202, the distance from the viewing position to each region of the display panel 10 may be detected, and then the viewing angle of the viewing position with respect to each region of the display panel 10 may be calculated out based on the distance from the viewing position to each region of the display panel 10.

In another aspect, an embodiment of the present disclosure also provides a method for controlling a display device. This method may be used in the display device according to the present disclosure, such as, the display device according to one or more embodiments disclosed above and/or below in more detail. Therefore, reference may be made to the embodiments of the display device for an alternative embodiment of the method. The method includes following steps, which may be performed according to given sequences or different sequences. Furthermore, additional method steps not listed may be provided. Furthermore, two or more or event all method steps may be at least partially performed simultaneously. Furthermore, the method steps may be repeatedly performed twice or more.

Figure 13:
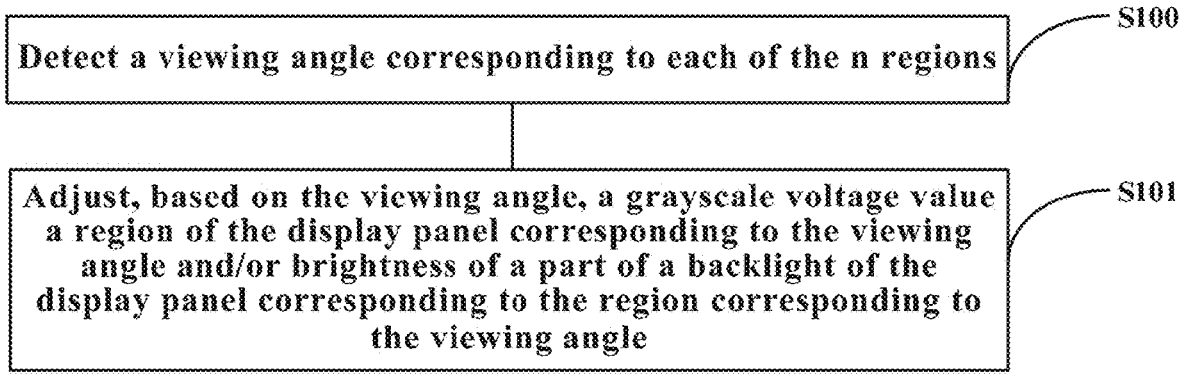
FIG. 13 is an exemplary flowchart of a method for controlling a display device according to an embodiment of the present disclosure.

In an exemplary embodiment of this method, the display device may include a display panel 10 which is divided into n regions along a horizontal viewing direction, wherein n is a positive integer and n≥2. As shown in FIG. 13, the method includes Steps S100-S101.

In Step S100, a viewing angle corresponding to each of the n regions is detected.

In this embodiment, the viewing angle is an angle between a sight line of a human eye and the display panel. The viewing angle corresponding to each region may be represented by one or both of following parameters: i) a distance from a viewing position to each of then regions of the display panel, and ii) a bending degree of the display panel in each of the n regions.

In the case where the display panel 10 is a flat display panel, the curvature of the flat display panel is zero, and thus the viewing angle is only related to the distance from the viewing position to each region of the display panel 10. Therefore, in this case, the viewing angle may be represented only by the distance from the viewing position to each region of the display panel 10. In the case where the display panel 10 is a small-sized curved display panel, such as a pair of wearable glasses or a wearable helmet, all light rays from the respective regions of the display panel to the viewing position may be considered as to be approximately parallel, that is, the distance from the viewing position to each region of the display panel 10 substantially has no effect on the viewing angle. In this case, the viewing angle is only related to the bending degree of the display panel 10 in each region. Therefore, the viewing angle may be represented only by the bending degree of the display panel 10 in each region. In the case where the display panel 10 is a large-sized curved display panel, the viewing angle is related to both the distance from the viewing position to each region of the display panel 10 and the bending degree of the display panel 10 in each region. Therefore, in this case, the viewing angle may be represented by the distance from the viewing position to each region of the display panel 10 and the bending degree of the display panel 10 in each region.

Here, the bending degree may be represented, for example, by curvature or radius of curvature. However, this is not intended to limit the scope of the present disclosure to a particular representation of the bending degree, and those skilled in the art may readily appreciate how to adapt relevant conditions and settings when other representations are employed. Furthermore, the present disclosure does not limit how to detect the bending degree of the display panel 10 in each region. As an example, the bending degree of the display panel 10 in each region may be detected by a curvature sensor.

Similarly, the present disclosure does not limit how to detect the distance from the viewing position to each region of the display panel 10. As an example, the distance may be detected by an infrared probe.

In Step S101, one or more of the followings are adjusted based on the viewing angle: i) a grayscale voltage value of a region of the display panel 10 corresponding to the viewing angle, and ii) brightness of a part of a backlight of the display panel 10 corresponding to the region corresponding to the viewing angle.

In this step, in the case where the display device is a liquid crystal display device, the liquid crystal display device may include, for example, a liquid crystal display panel and a backlight which is used for providing a light source for the liquid crystal display panel. The grayscale voltage value of the region of the display panel 10 corresponding to the viewing angle may be adjusted based on the viewing angle. In an alternative embodiment, the brightness of the part of the backlight of the display panel 10 corresponding to the region corresponding to the viewing angle may be adjusted based on the viewing angle. In another alternative embodiment, both the grayscale voltage value of the region of the display panel 10 corresponding to the viewing angle and the brightness of the backlight of the display panel 10 corresponding to the region corresponding to the viewing angle may be adjusted based on the viewing angle.

In the case where the display device is an organic light-emitting diode display device, the grayscale voltage value of the region of the display panel 10 corresponding to the viewing angle may be adjusted based on the viewing angle.

By way of example, the grayscale voltage value of the corresponding region may be implemented by adjusting the magnitude of the voltage applied to a data line. The brightness of the part of the backlight corresponding to the corresponding region may be implemented by adjusting the magnitude of current.

In some embodiments of the present disclosure, by adjusting the grayscale voltage value of each region or the brightness of the part of the backlight corresponding to each region, uniformity of an image to be displayed on the display panel may be adjusted, such that the display effect may be improved.

In an exemplary embodiment of the present disclosure, as described above, the grayscale voltage value of each region of the display panel 10 and/or the brightness of the part of the backlight of the display panel 10 corresponding to the region corresponding to the viewing angle may be adjusted based on the viewing angle corresponding to each region of the display panel, and thus images to be displayed on the display panel 10 may be adjusted. As an example, as the viewing angle decreases, adjustment may be performed by one or two of the following operations: i) reducing the grayscale voltage value of the region of the display panel 10 corresponding to the viewing angle, and ii) increasing the brightness of the part of the backlight of the display panel 10 corresponding to the region corresponding to the viewing angle. By adjusting one or both of the grayscale voltage value applied to the display panel 10 and the brightness of the backlight, it may be avoided a phenomenon that the viewer may see uneven images (for example, color shift) on the display screen when the viewer views from the side or the display panel 10 is bent, such that the quality of the displayed image is improved.

In the case where the display panel 10 is a liquid crystal display panel, as an example, the grayscale voltage value of the region of the display panel 10 corresponding to the viewing angle may be decreased as the viewing angle is decreased. As another example, the brightness of the part of the backlight of the display panel 10 corresponding to the region corresponding to the viewing angle may be increased as the viewing angle is decreased. As still another example, the grayscale voltage value of the region of the display panel 10 corresponding to the viewing angle may be decreased, and the brightness of the part of the backlight of the display panel 10 corresponding to the region corresponding to the viewing angle may be increased as the viewing angle is decreased. In the case where the display panel 10 is an organic light-emitting diode display panel, only the grayscale voltage value of the region of the display panel 10 corresponding to the viewing angle may be decreased as the viewing angle decreases.

Here, the decrease magnitude of the grayscale voltage value for the corresponding region and the increase magnitude of the brightness of the backlight may be determined based on the viewing angle, such that an image to be displayed by the display panel 10 has no or smaller color shift after being adjusted. By way of example, the smaller the viewing angle is, the more the grayscale voltage value decreases, and the more the brightness of the backlight increases.

The above is merely specific embodiments of the present disclosure, but the protection scope of the present disclosure is not limited thereto. Any variation or substitution easily conceivable to those skilled in the art shall fall into the protection scope of the present disclosure. Therefore, the protection scope of the present disclosure shall be subject to the protection scope of the claims.

The invention claimed is:

1. A display device comprising:

a display panel divided into n regions along a horizontal viewing direction, wherein n is a positive integer and n≥2;

a detection unit configured to detect a viewing angle corresponding to each of the n regions, the viewing angle being an angle between a sight line of a human eye and the display panel, wherein the detection unit comprises m bending degree detection subunits configured to detect a bending degree of the display panel in the region, wherein m is a positive integer and m≥n, wherein if m is greater than n, a region having a larger bending degree among the n regions is provided with at least two said bending degree detection subunits, and wherein each of the m bending degree detection subunits comprises a curvature sensor; and a control unit configured to adjust, based on the viewing angle, at least one of:

a grayscale voltage value of a region of the display panel corresponding to the viewing angle; and a brightness of a part of a backlight of the display panel corresponding to the region corresponding to the viewing angle, wherein the viewing angle is represented by at least one of the following parameters:

a distance from a viewing position to each of the n regions of the display panel; and the bending degree of the display panel in each of the n regions.

2. The display device according to claim 1, wherein the control unit is configured to perform the adjustment by at least one of following operations:

reducing the grayscale voltage value of the region corresponding to the viewing angle as the viewing angle is decreased; and increasing the brightness of the part of the backlight of the display panel corresponding to the region corresponding to the viewing angle as the viewing angle is decreased.

3. The display device according to claim 1, wherein the bending degree detection subunits are arranged on the display panel.

4. The display device according to claim 1 further comprising a flexible substrate arranged on a side away from a light exit side of the display panel, wherein the bending degree detection subunits are arranged on the flexible substrate.

5. The display device according to claim 1, wherein the detection unit further comprises n position detection subunits corresponding to the n regions, and wherein each of the position detection subunits is configured to detect the distance from the viewing position to the corresponding region of the display panel, and wherein each of the n position detection subunits comprises an infrared sensor.

6. The display device according to claim 1, wherein the detection unit further comprises one position detection subunit positioned in one of the n regions, and wherein the one position detection subunit is configured to detect the distance from the viewing position to the region where the one position detection subunit is located, and calculate distances from the viewing position to other regions of the n regions based on i) an angle between the display panel and a connecting line of the viewing position and the one position detection subunit and ii) distances from the other regions to the region where the one position detection subunit is located, and wherein the one position detection subunit comprises an infrared sensor.

7. The display device according to claim 1, wherein the display device is one of a liquid crystal display device and an organic light emitting diode (OLED) display device.

8. A method for controlling a display device which comprises a display panel divided into n regions along a horizontal viewing direction, wherein n is a positive integer and n≥2, the method comprising:

detecting, by a detection unit, a viewing angle corresponding to each of the n regions, the viewing angle being an angle between a sight line of a human eye and the display panel, wherein the detection unit comprises m bending degree detection subunits configured to detect a bending degree of the display panel in the region, wherein m is a positive integer and m≥n, wherein if m is greater than n, a region having a larger bending degree among the n regions is provided with at least two of said bending degree detection subunits, and wherein each of the m bending degree detection subunits comprises a curvature sensor; and adjusting, by a control unit, based on the viewing angle, at least one of:

a grayscale voltage value of a region of the display panel corresponding to the viewing angle; and a brightness of a part of a backlight of the display panel corresponding to the region corresponding to the viewing angle, wherein the viewing angle corresponding to each region is represented by at least one of the following parameters:

a distance from a viewing position to each of the n regions of the display panel; and the bending degree of the display panel in each of the n regions.

9. The method according to claim 8, wherein the adjusting comprises at least one of:

reducing the grayscale voltage value of the region corresponding to the viewing angle as the viewing angle is decreased; and increasing the brightness of the part of the backlight of the display panel corresponding to the region corresponding to the viewing angle as the viewing angle is decreased.

10. The method according to claim 8, wherein the detection unit further comprises n position detection subunits corresponding to the n regions, wherein each of the position detection subunits is configured to detect the distance from the viewing position to the corresponding region of the display panel, and wherein each of the n position detection subunits comprises an infrared sensor.

11. The method according to claim 8, wherein the detection unit further comprises one position detection subunit positioned in one of the n regions, wherein the one position detection subunit is configured to detect the distance from the viewing position to the region where the one position detection subunit is located, and calculate distances from the viewing position to other regions of the n regions based on i) an angle between the display panel and a connecting line of the viewing position and the one position detection subunit and ii) distances from the other regions to the region where the one position detection subunit is located, and wherein the one position detection subunit comprises an infrared sensor.

* * * * *